US005636477A

United States Patent [19]

Hulse et al.

[11] Patent Number: 5,636,477

[45] Date of Patent: Jun. 10, 1997

[54] MAT MONITOR MODULE

[75] Inventors: Jon J. Hulse, Wethersfield; Stephen L. Gemmell, Newington, both of Conn.

[73] Assignee: The Stanley Works, New Britain, Conn.

[21] Appl. No.: 628,575

[22] Filed: Apr. 4, 1996

[51] Int. Cl.[6] ..... E05F 13/00

[52] U.S. Cl. ..... 49/264; 49/13

[58] Field of Search ..... 49/264, 13, 14, 49/25, 26, 28

[56] References Cited

U.S. PATENT DOCUMENTS 4,334,388 6/1982 Kambic ..... 49/14
4,467,391 8/1984 Refoy et al. ..... 49/264 X
4,501,090 2/1985 Yoshida et al. ..... 49/264
4,614,057 9/1986 Sorber ..... 49/264
4,669,218 6/1987 Kornbrekke et al. ..... 49/264 X

*Primary Examiner*—Philip C. Kannan
*Attorney, Agent, or Firm*—Chilton, Alix & Van Kirk

[57] ABSTRACT

A mat monitor for an automatic swing door system is mountable in-line with an approach mat and a safety mat and the controller for the automatic door system. The monitor emits a visible light to indicate that a mat is properly operating without requiring that the door cycle through an opening/closing sequence. In one embodiment, a green light is illuminated to indicate that the approach mat is properly functioning and a red light is illuminated to indicate that a safety mat is properly functioning. The mat monitor is preferably mounted at the underside of the header adjacent to the controller.

20 Claims, 5 Drawing Sheets

MAT MONITOR MODULE

BACKGROUND OF THE INVENTION

This invention relates generally to automatic door systems which employ approach and safety sensor systems to provide input for controlling the position of a door. More particularly, the present invention relates to automatic swing doors which employ mats to provide input signals to open and close the door or maintain the position of the door.

In automatic door systems to which the invention relates, a swing door operator swings a door from a closed to a full open position and maintains the position and/or closes the door in response to signals from an electronic controller. Typically, an approach mat or an approach sensor provides a signal to the control system to open or maintain the door in an open position. A safety mat is positioned on the egress side of the swing door to maintain the door in an open position as a person passes through the doorway and also to prevent a door from swinging open into the path of a person who may be standing at the swing side of a closed door. In conventional fashion, the control system receives input signals from the approach mat or approach sensor and the safety mat and processes the signals to provide the opening, closing and positioning logic for the proper operation of the door. The control transmits commands to the operator to implement various time delays and to control the speed, direction and power limiting functions for the door.

In conventional systems for which the invention has applicability, when a person steps on an approach mat, the door swings to a full open position and remains fully open while the person is on the approach mat. If the person steps off the approach mat without crossing the threshold, a timer starts. After expiration of a pre-established time interval, such as, for example, six seconds, the door will begin a closing cycle. Commonly, the closing speed is reduced as the swing door approaches the closed position. The control logic generates a hold open delay signal when a person steps on the approach mat and crosses the threshold of the open door. As long as the person stays on the safety mat, the door remains in the open position. If the person leaves the safety mat, the door typically closes after a pre-established second hold open delay which is typically one and a half seconds. As an additional safety feature, if a person is standing on the safety mat and a person steps on the approach mat or comes within the approach sensor, the door will not open but will remain in the closed position. Once the person steps off the safety mat, the door will resume a normal cyclical operation upon expiration of a safety delay time interval.

Proper functioning of the approach and safety mats is a predicate to proper operation of the automatic door system. It is highly desirable that the operational sequence be routinely checked and that the mats be thoroughly checked to verify that they provide good contact characteristics throughout the effective contact area of the mats. Under normal conditions, thorough monitoring of the mats or the approach sensor cannot be accomplished in an efficient time effective manner because the door would normally recycle through the various operational sequences. Consequently, in practice, thorough monitoring of the approach and safety mats may be compromised by the time required to carry out the monitoring task.

SUMMARY OF THE INVENTION

Briefly stated, the invention in a preferred form is a mat monitor module that is mounted at the underside of the header and installed in in-line relationship between the controller and the approach mat or sensor and the safety mat. The mat monitor module provides a visual indication of the proper operation of the approach sensor or approach mat and safety mat while the automatic door system is placed in a door hold open mode. The monitor includes a first input which communicates with the approach mat and a second input which communicates with the safety mat. A bi-color LED is illuminated to indicate that the contact points of the mats are properly operating without recycling the door through the opening/closing sequences.

In one embodiment, a green light source is illuminated to indicate that the approach mat or approach sensor is properly operating and a red light source is illuminated to indicate that the safety mat is properly operating. The LED is preferably positioned in an opening of the header. The module includes a circuit board which functions as the principal support structure and which mounts the various circuitry. A double sided adhesive strip is employed to fasten the circuit board to the top and the bottom panel of the header.

Optical couplers are employed to isolate the signals from the monitor module. Isolated conditioned output signals from the module are applied to the activate and safety lines to the controller.

An object of the invention is to provide a new and improved mat monitor module which provides a quick and efficient test of the integrity of the safety mat and approach mat or approach sensor.

Another object of the invention is to provide a new and improved mat monitor module which is relatively inexpensive and easy to install.

A further object of the invention is to provide a new and improved mat monitor module which provides an efficient indication of proper functioning of the approach sensor or mat and the safety mat for an automatic door system.

Other objects and advantages of the invention will become apparent from the specification and the drawings.

DETAILED DESCRIPTION OF THE PREFERRED EMBODIMENT

Figure 1:
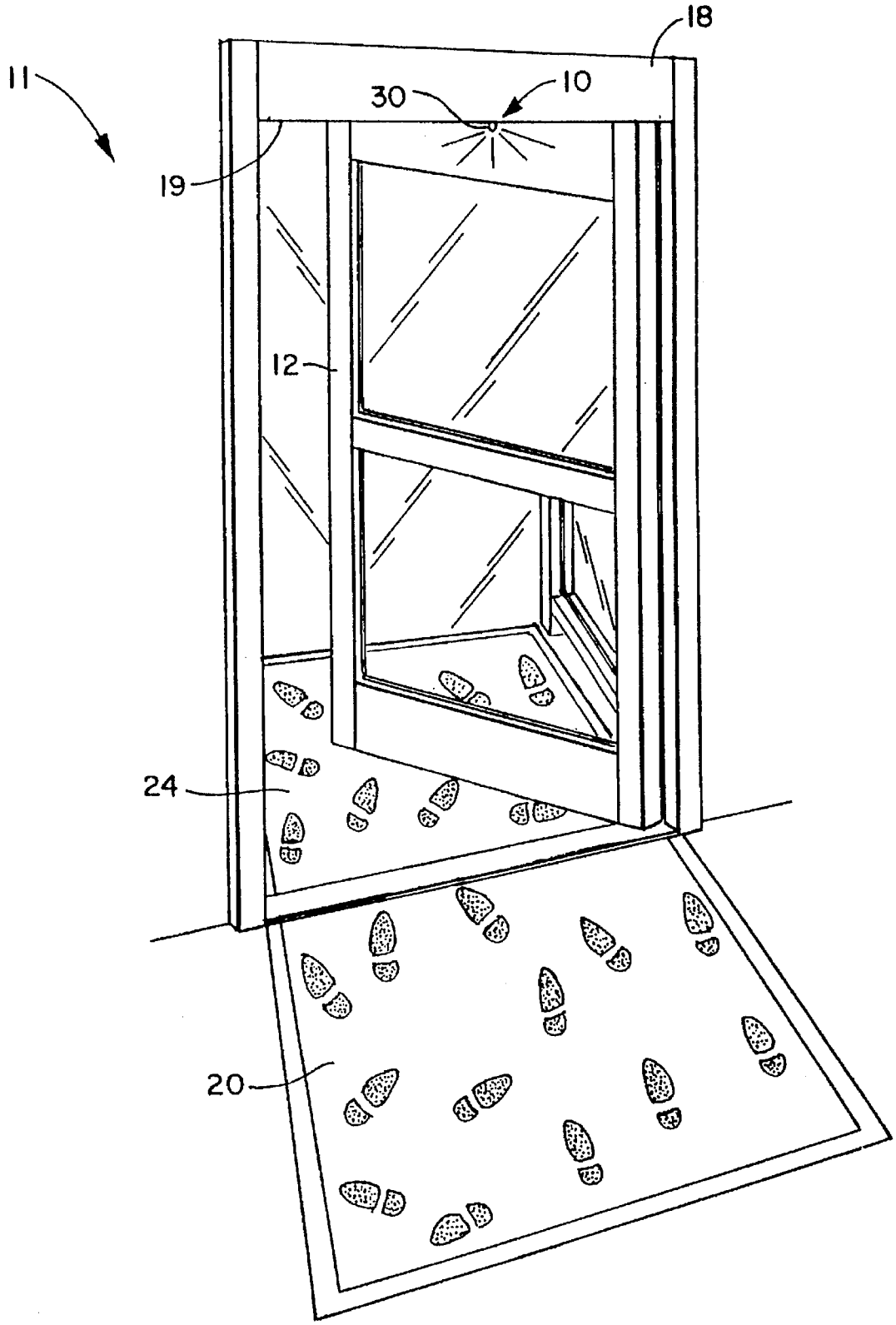
FIG. 1 is a perspective view, partly in schematic, illustrating an automatic swing door system and an installed mat monitor module in accordance with the present invention.

With reference to the drawings wherein like numerals represent like parts throughout the figures, an automatic swing door system which incorporates a mat monitor module 10 in accordance with the invention is generally designated by the numeral 11. The mat monitor module 10 is adapted to be installed in a pre-existing automatic swing door system to monitor the operation of the approach mat or the approach sensor and the safety mat while the door is maintained in a hold open mode without cycling the door through the opening/closing sequence. The mat monitor module may also be used in sliding door, telescoping door and bifold door systems.

The swing door system functions to automatically open and close a swing door 12 and may assume a wide variety of forms. The position of door 12 is mechanically controlled by an operator 14 that transforms motor revolutions into an angular positioning of the door from a full close to a full open position. The door typically subtends a 90° angle during the swing travel. A controller 16 transmits command signals to the operator 14. The operator 14 and the controller 16 are mounted in the header 18 of the entranceway.

Figure 5:
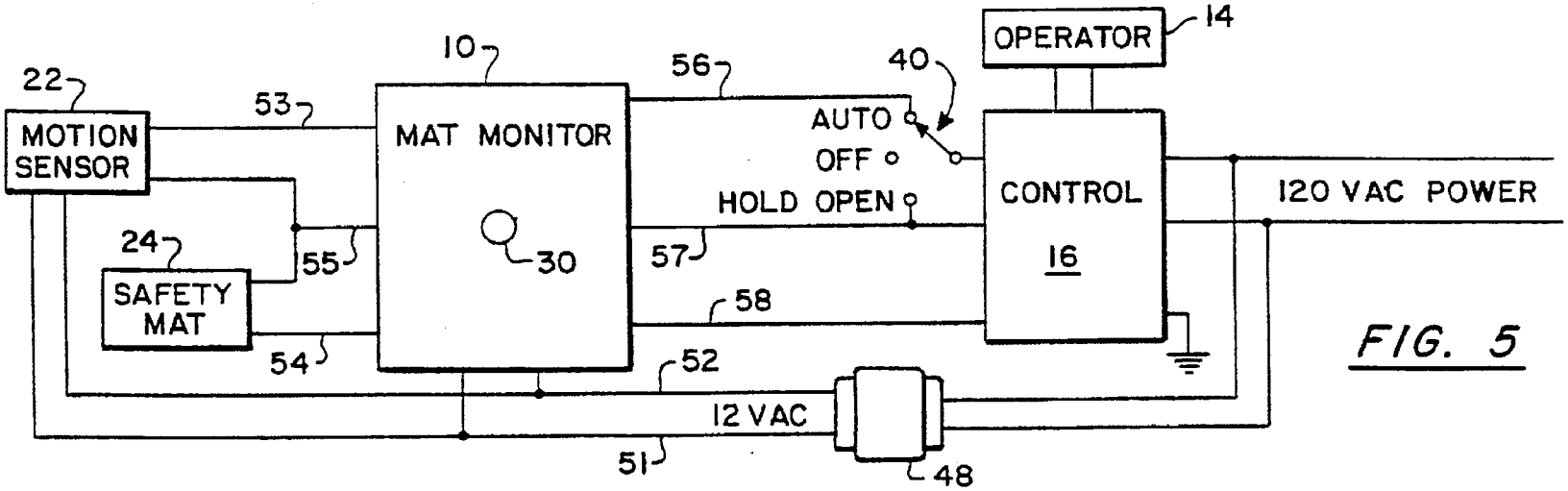
FIG. 5 is a schematic diagram illustrating the interface between the mat monitor module of FIG. 1 and an automatic door system employing an approach sensor and a safety mat.

The controller 16 is preferably an electronic control system which supplies power to the operator to open the door. The controller 16 receives input signals indicative of a person attempting to enter or egress through the door or the presence of a person in the vicinity of the door and provides the door system logic, including time delays and motor control, which controls the speed, direction and power limiting function for the door operation. Typically an approach mat 20 or an approach sensor 22 (FIG. 5) at the entrance side of the entranceway provides an input signal to the controller 16 to open the door and/or maintain the door in an open position. A safety mat 24 is positioned at the egress side of the door. The safety mat 24 maintains the door in an open position as a person passes through the doorway from the approach side. In addition, the safety mat provides an input signal to prevent the door from opening into the path of a person who is standing on the swing side of a closed door.

Figure 4:
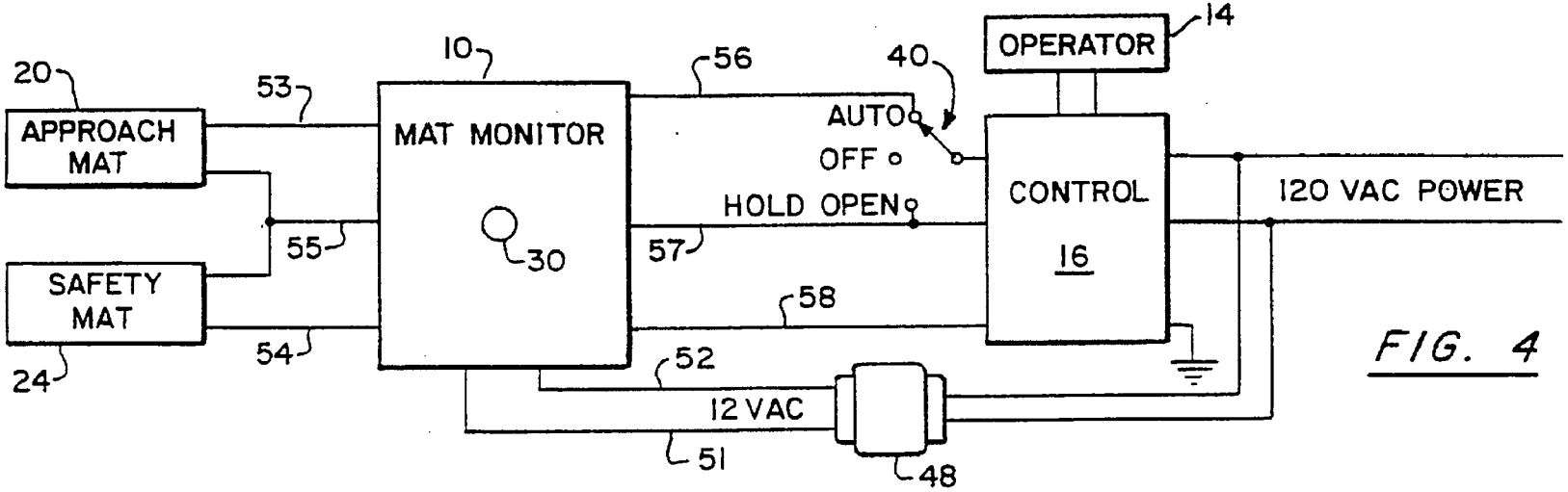
FIG. 4 is a schematic diagram illustrating the interface between the mat monitor module of FIG. 1 and an automatic door system employing an approach mat and a safety mat.
Figure 6:
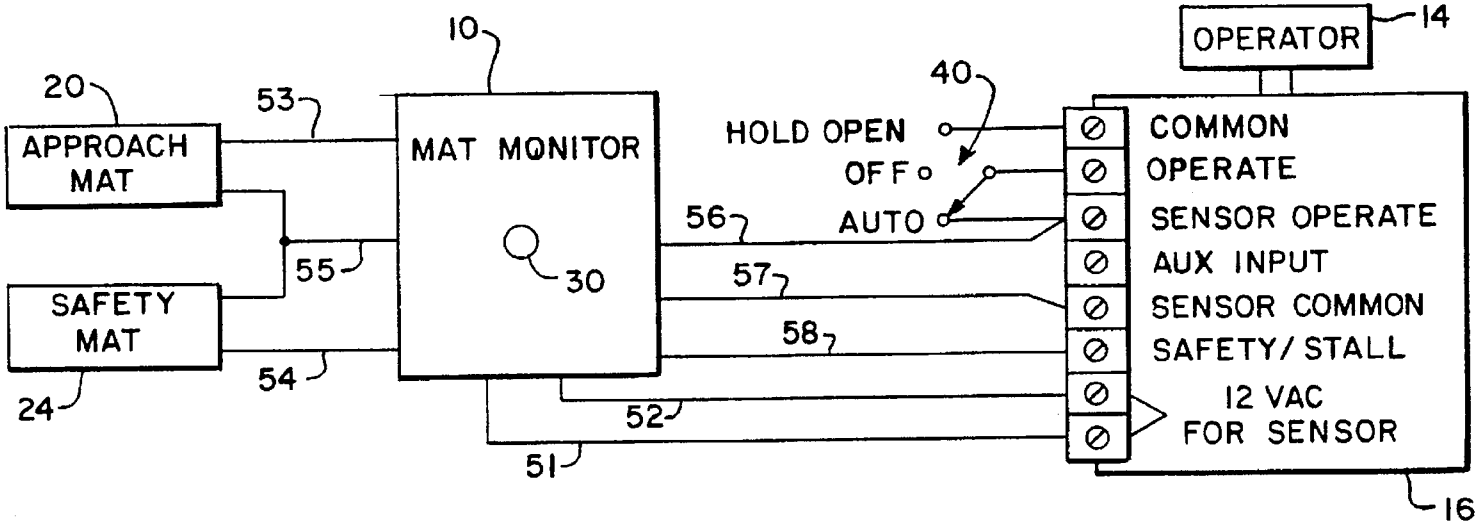
FIG. 6 is a schematic diagram illustrating the interface between the mat monitor module of FIG. 1 and an automatic door system employing a controller having a microprocessor and an approach mat and a safety mat.
Figure 7:
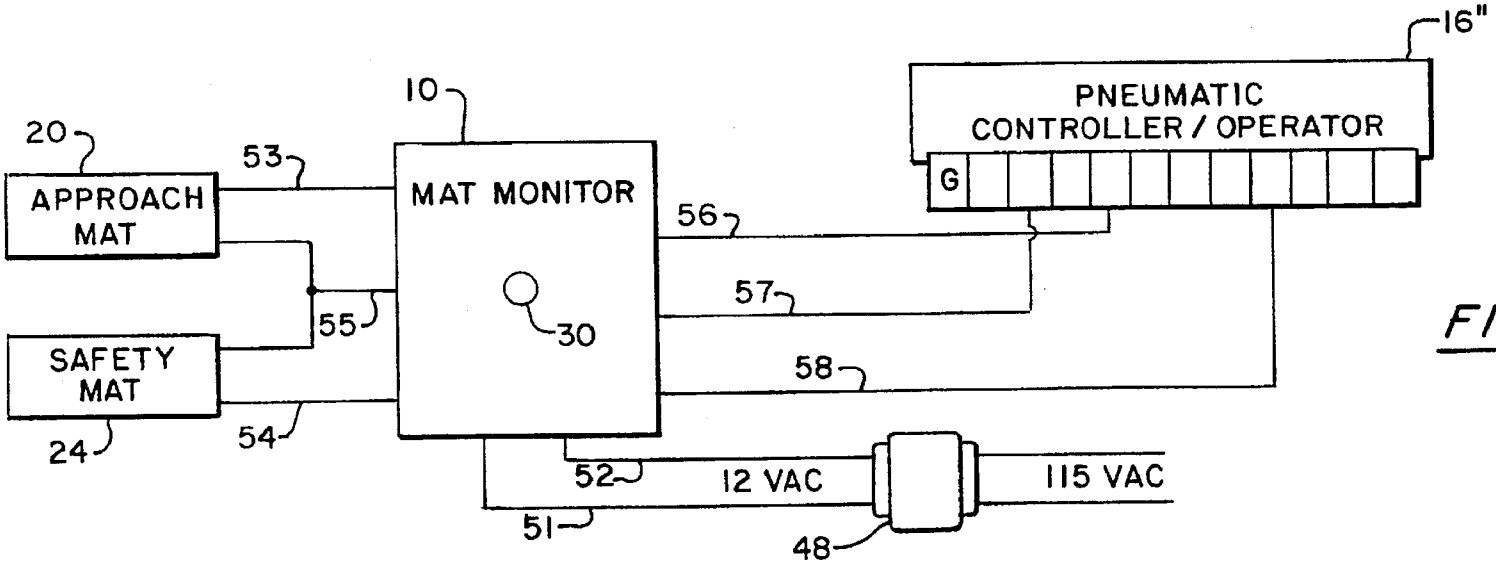
FIG. 7 is a schematic diagram illustrating the interface between the mat monitor module of FIG. 1 and an automatic door system employing a pneumatic operator and an approach mat and a safety mat.

The controller 16 is representative of a wide variety of forms which may include, for example, circuitry which controls the speed and position of the operator (FIGS. 4 and 5), controller 16' having microprocessor based circuitry which connects with an approach sensor or mat for providing the logic for the door operator (FIG. 6) or controller/operator 16" having circuitry which controls a pneumatic operator (FIG. 7). The controllers include a three position switch 40 having an automatic mode, an off mode and a door hold open mode. The mat monitor module 10 connects in-line to the controller 16 regardless of the switch position. However, the mat monitor module has particular usefulness when the controller is switched to the hold open mode for the door and tests are undertaken on the approach mat 20 or approach sensor 22 and the safety mat 24.

In accordance with the invention, the mat monitor module 10 is an auxiliary module which may be incorporated into an existing automatic door system to thoroughly and efficiently monitor the operation of the approach mat 20 or approach sensor 22 and the safety mat 24 without requiring the door to cycle through the opening and closing sequences. The mat monitor module electrically connects in-line with the controller 16, 16', 16" and the various leads to the controller in the header 18. The monitor 10 has a bi-color LED 30 which is energizable to provide visual indication of the proper operation of the approach mat or approach sensor and the safety mat.

Figure 3:
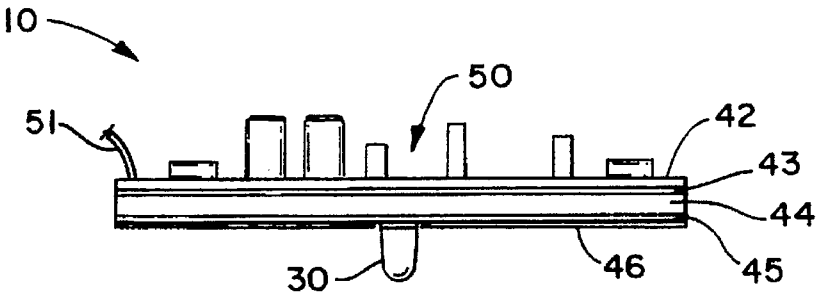
FIG. 3 is a side elevational view of the mat monitor module of FIG. 1 in a pre-installed configuration.

With reference to FIG. 3, the mat monitor module 10 comprises a circuit board 42 which mounts various components and defines a monitor circuit 50. (See FIG. 8.) A two-sided adhesive foam tape 44 having adhesive strips 43 and 45 is mounted at the underside of the circuit board to provide a means for securing the circuit board to the header as will be further described below. In the pre-installed mode, an outer removable protective strip 46 covers the outer strip adhesive 45. The circuit 50 electrically connects with the door system via lines 51 through 58, as will be further described below.

The mat monitor circuit 50 is preferably powered by a 12 VAC accessory transformer 48 (FIGS. 4, 5 and 7) or for some applications a 12 VAC supply which is employed for the motion sensor and may be incorporated into the controller (FIG. 6). The circuit 50 is an interface circuit connected in-line between the approach mat or approach sensor (which may be a motion sensor) and the safety mat and the controller. The circuit supplies an AC voltage to the mats or sensor for monitoring the inputs and operations of the mats or sensor. The bi-color red/green LED 30 provides a visual indication when contact is made with the appropriate approach or safety mat and the mat is properly operating or when the approach sensor is properly operating.

Figure 8:
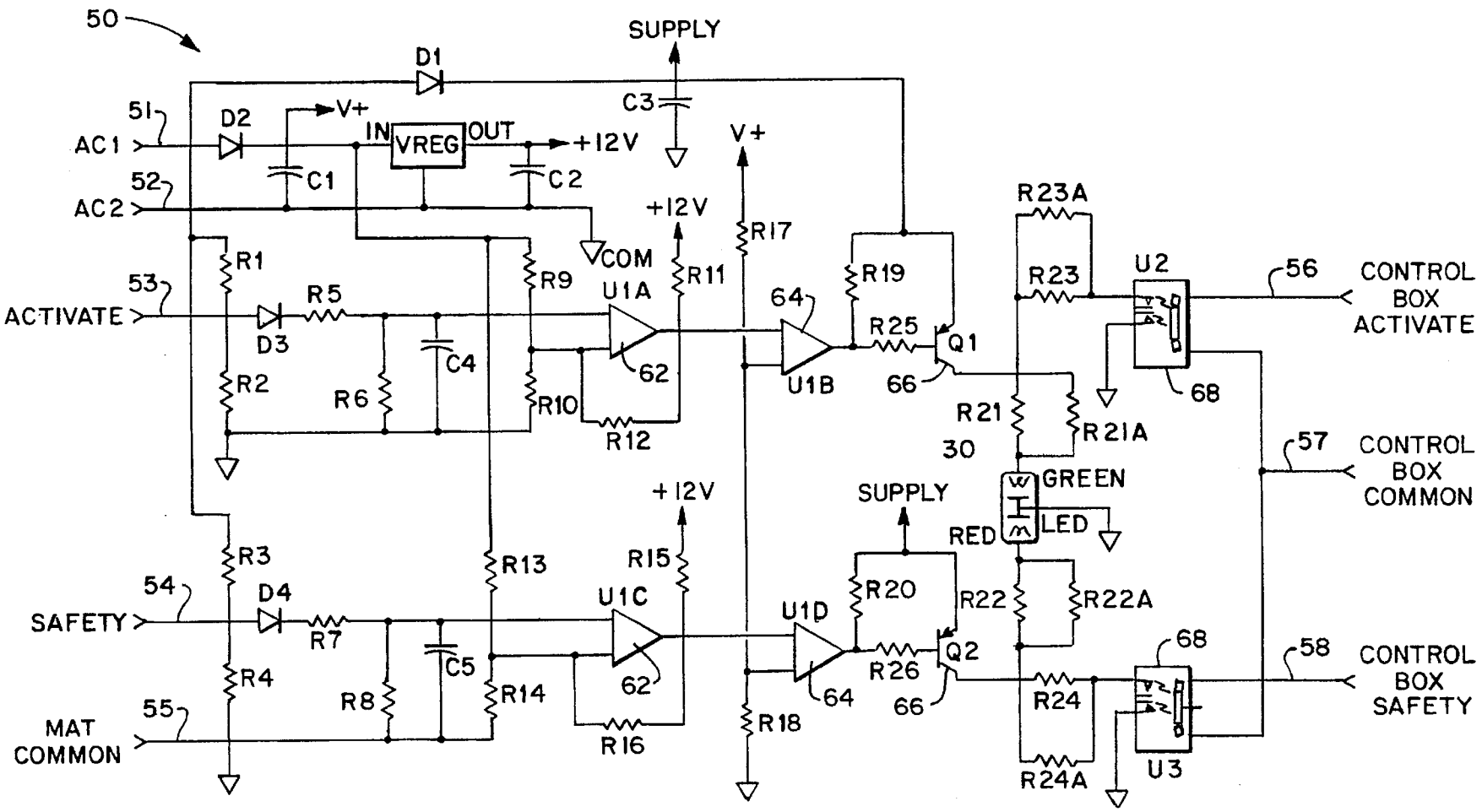
FIG. 8 is a schematic circuit diagram of the mat monitor module of FIG. 1.

With reference to FIG. 8, the circuit connects the 12 volt power source via lines 51 and 52 with a 12 volt voltage regulator 60 to provide a reference voltage. Line 53 connects the approach mat or sensor output via a voltage divider with a comparator 62 having an input reference. The output from comparator 62 is applied to an inverter comparator 64 which drives a transistor 66. The output from the transistor forms a conditioned logic signal for energizing the green illuminator of the bi-color LED 30. The output is also applied via an open collector optic coupler 68 for connection with the controller 16 via activate output line 56.

Likewise, line 54 from the safety mat also connects via comparators 62, 64 and a transistor 66 for energizing the red illuminator of the bi-color LED 30. The output from the safety sensor then is applied via output safety line 58 across a second open collector optic coupler 68 for connection with the safety terminal of the controller. The couplers 68 isolate the signals between the monitor module and the controller.

Figure 2:
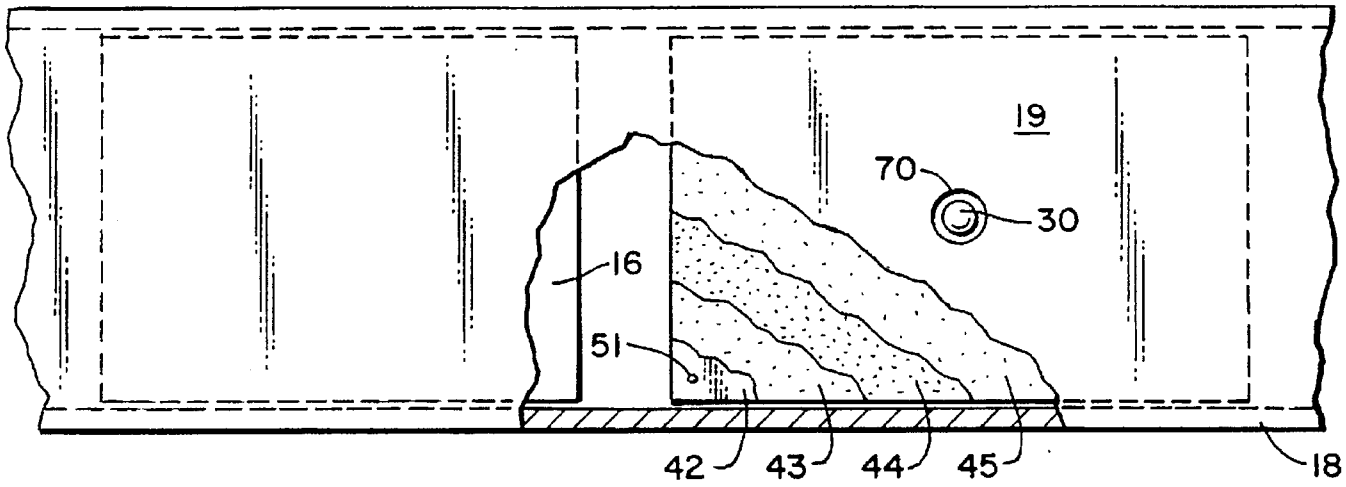
FIG. 2 is a bottom plan view, partly in phantom, partly broken away, and partly in section of the mat monitor module, the controller and a portion of the header for the automatic swing door system of FIG. 1.

With reference to FIGS. 1–3, the mat monitor module 10 is adapted for efficient installation in a pre-existing automatic door system 11. A hole 70 (FIG. 2) is drilled through the bottom panel 19 of the header near the controller 16 which is typically housed in a box. The outer strip 46 is removed from the double sided tape. The LED 30 is placed in the opening 70, allowing the board to adhere to the top of the bottom panel of the header with the LED 30 extending downwardly from the underside of the header. The appropriate lines 51–58 are then connected to form the electrical connection with the controller and the approach sensor or approach mat and safety mat wiring. For some applications, a 12 volt AC auxiliary transformer 48 must also be employed.

The mat monitor module 10 may be employed in an efficient manner by placing the switch 40 at the door hold open position. The mat monitor provides a ready visual indication of the mat or approach sensor integrity by energizing the bi-color LED 30 to emit a green light to indicate proper operation for the approach mat or approach sensor and a red light for the safety mat. Preferably, the mat or sensor is tested by dividing the mat or sensor zone into subregions and exerting a pressure with the toe to each of the various regions, as schematically illustrated in FIG. 1, to determine the integrity of each portion of the mat or sensor zone. The LED is monitored for the green illumination at each test point. The procedure is also repeated for the safety mat in which case a red illumination is emitted. It should be appreciated that after the mats are checked with the mat monitor, the controller switch 40 is then transformed to the automatic state and a maintenance check of the normal door cycle is then undertaken.

During the mat monitoring process, if the monitor LED 30 does not indicate a proper illumination for a test point, then the appropriate mat should be inspected for various imperfections, such as cracks, splits or tears in the mat surface or loose or bent molding and missing anchor screws. Likewise, the approach sensor or appropriate processing should be checked for installations which employ an approach sensor and which fail to generate a proper illumination for a test point.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A monitor module for an automatic door system comprising an activate unit generating an activate input and a safety unit for generating a safety input and a control unit responsive to said activate and safety inputs for controlling a door operator comprising:

first input means for electrically communicating with said activate input;

second input means for electrically communicating with said safety input;

first output means for communicating with an activate terminal of said control unit;

second output means for communicating with a safety terminal of said control unit;

circuit means communicating with said first and second input means and said first and second output means for generating conditioned signals to said control unit and comprising indicator means for indicating whether the approach and safety units are properly operating; and mounting means for mounting said circuit means in fixed relation to said control unit.

2. The monitor module of claim 1 wherein said indicator means comprises a selectively illuminatable light source.

3. The monitor module of claim 1 wherein said indicator means comprises a bi-color LED.

4. The monitor module of claim 3 wherein said LED illuminates one light source color indicative of proper operation of the activate unit and a different light source color indicative of proper operation of the safety unit.

5. The monitor module of claim 3 wherein said bi-color LED has a green and a red light source.

6. The monitor module of claim 1 wherein said mounting means further comprises an adhesive strip.

7. The monitor module of claim 1 further comprising a circuit board, said circuit means being mounted to said circuit board, and said mounting means being attached to said circuit board.

8. The monitor module of claim 7 wherein said circuit board has first and second sides and said circuit means further comprises electronic components mounted to said first side and an LED extending from said second side.

9. The monitor module of claim 1 wherein said circuit means further comprises isolator means for electrically isolating output signals of said circuit means from said control unit.

10. An automatic door system comprising:

entranceway means comprising a swing door;

activate means for generating an activate signal indicative of a person in the vicinity of the entrance side of the door;

safety means for generating a safety signal indicative of a person in the vicinity of the egress side of the door;

monitor means responsive to said activate and safety signals for generating a first visual signal indicative of the transmission of said activate signal and a second visual signal indicative of the transmission of said safety signal and for generating an output activate signal and an output safety signal;

control means responsive to said output activate signal and said output safety signal for generating operational signals; and operator means responsive to said operational signals for controlling the operation of said door.

11. The automatic door system of claim 10 wherein said first visual signal is a green light and said second visual signal is a red light.

12. The automatic door system of claim 10 wherein said monitor means comprises a bi-color LED.

13. The automatic door system of claim 10 wherein said entranceway means further comprises a header disposed above said door and wherein said monitor means, said control means and said operator means are mounted to said header.

14. The automatic door system of claim 13 wherein said header further defines an opening and said monitor means further comprises an LED, said monitor means being mounted to said header, wherein said LED extends through said opening.

15. The automatic door system of claim 10 wherein said monitor means further comprises a pair of optical couplers.

16. The automatic door system of claim 10 wherein said entranceway means further comprises a header disposed above said swing door and said header further defines an opening, and said monitor means further comprises a circuit board and an LED, said circuit board being fixedly mounted to said header, with said LED being disposed in said opening.

17. A monitor module for an automatic door system comprising an activate unit for generating an activate input and a safety unit for generating a safety input and a control unit responsive to said activate and safety inputs for controlling the operation of a door comprising:

first input means for electrically communicating with said activate input;

second input means for electrically communicating with said safety input;

first output means for communicating with an activate terminal of said control unit;

second output means for communicating with a safety terminal of said control unit;

circuit means comprising a circuit board and circuitry communicating with said first and second input means and said first and second output means for generating conditioned signals to said control unit and comprising first emitter means for indicating whether the activate unit is properly operating and second emitter means for indicating whether the safety unit is properly operating; and mounting means attached to said circuit board for mounting said circuit means in fixed relation.

18. The monitor module of claim 17 wherein said mounting means comprises a two sided adhesive strip.

19. The monitor module of claim 17 wherein said first emitter means is a green light source and said second emitter means is a red light source.

20. The monitor module of claim 1 wherein said circuitry further comprises electronic components and said circuit board has a first side and a second side, said components being mounted to said first side, and said first and second emitter means extending outwardly from said second side.

* * * * *

UNITED STATES PATENT AND TRADEMARK OFFICE

CERTIFICATE OF CORRECTION

PATENT NO. : 5,636,477
DATED : June 10, 1997
INVENTOR(S) : Jon J. Hulse

It is certified that error appears in the above-indentified patent and that said Letters Patent is hereby corrected as shown below:

Column 8, line 1, change "1" to --17--.

Signed and Sealed this

Twenty-fifth Day of November, 1997

*Attest:*

BRUCE LEHMAN

*Attesting Officer*

*Commissioner of Patents and Trademarks*